US006816120B2

(12) United States Patent
Kuramoto

(10) Patent No.: US 6,816,120 B2
(45) Date of Patent: Nov. 9, 2004

(54) LAN ANTENNA AND REFLECTOR THEREFOR

(75) Inventor: Akio Kuramoto, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/128,427

(22) Filed: Apr. 24, 2002

(65) Prior Publication Data

US 2002/0158807 A1 Oct. 31, 2002

(30) Foreign Application Priority Data

Apr. 26, 2001 (JP) ..... 2001-129663

(51) Int. Cl.[7] ..... H01Q 1/24
(52) U.S. Cl. ..... 343/702; 343/834
(58) Field of Search ..... 343/702, 834, 343/872, 873, 905

(56) References Cited

U.S. PATENT DOCUMENTS

| | | | | |
|---|---|---|---|---|
| 2,452,767 A | | 11/1948 | Kraus | 250/33.65 |
| 2,594,839 A | | 4/1952 | Alford | 250/33.65 |
| 3,064,258 A | | 11/1962 | Hatkin et al. | 343/757 |
| 4,195,301 A | * | 3/1980 | Conroy | 343/700 MS |
| 5,335,366 A | * | 8/1994 | Daniels | 455/575 |
| 5,373,304 A | * | 12/1994 | Nolan et al. | 343/841 |
| 5,581,262 A | * | 12/1996 | Kawahata et al. | 343/700 MS |
| 6,172,650 B1 | | 1/2001 | Ogawa et al. | 343/836 |

FOREIGN PATENT DOCUMENTS

| | | |
|---|---|---|
| DE | 44 38 435 A1 | 5/1996 |
| DE | 299 15 174 U1 | 1/2000 |
| JP | 6-350334 | 12/1994 |
| JP | 7-55862 | 3/1995 |
| JP | 8-84148 | 3/1996 |
| JP | 8-307142 | 11/1996 |
| JP | 8-321799 | 12/1996 |
| JP | 8-335825 | 12/1996 |
| JP | 10-502220 | 2/1998 |
| JP | 2000-183796 | 6/2000 |

OTHER PUBLICATIONS

European Search Report dated Feb. 28, 2003.
Jasik, Henry: "Antenna Engineering Handbook", 1984, McGraw–Hill, pp. 4–6, 4–20.

* cited by examiner

*Primary Examiner*—Shih-Chao Chen
(74) *Attorney, Agent, or Firm*—McGinn & Gibb, PLLC

(57) ABSTRACT

A cylindrical reflector having a through hole in conformity with the shape of an elemental portion is fitted to the elemental portion in a LAN antenna in which the elemental portion encloses a linear conductor therein and projects from a base table, and further, the reflector is turned to be set at a position at which the directivity is formed in a specific direction. A flat plate or a curved plate forming a reflecting surface of the reflector is arbitrarily set, thus forming a desired radiation pattern of a beam.

8 Claims, 13 Drawing Sheets

LAN ANTENNA AND REFLECTOR THEREFOR

BACKGROUND OF THE INVENTION

1. Field of the Invention

The present invention relates to a LAN antenna having a directivity in a specific direction, and a reflector therefor.

2. Related Art

In view of this, Japanese Unexamined Patent Publication (KOKAI) No. 6-350334 discloses the technique in which a reflecting element is subjected to an arcuate motion on an axis of an antenna element so as to provide the directivity in a specific direction.

Furthermore, Japanese Unexamined Patent Publication (KOKAI) No. 10-502220 discloses the configuration in which a plurality of monopole antenna elements uniformly spaced on the circumference are electrically operated so as to achieve an optimum directivity.

If the above-described non-directivity antenna is used in the case where a plurality of access points exist in a wide area, there arises a problem of the interference between the access points or a problem of which point a terminal located between the access points should access to.

In spite of the use of the directivity antenna by the technique disclosed in Japanese Unexamined Patent Publication (KOKAI) No. 6-350334 or Japanese Unexamined Patent Publication (KOKAI) No. 10-502220, the possibility of achievement of an antenna radiation pattern capable of satisfying a demand is not sufficient. Therefore, a desired gain, beam width or side lobe characteristics may not be obtained according to the radiation pattern from the above-mentioned antennas so that the above-described problems cannot be solved. Additionally, a throughput cannot be enhanced in many cases.

In these cases, if the antenna radiation directivity, that is, the beam shape, beamwidth, side lobe characteristics, gain or the like can be readily changed or adjusted in the antenna on a terminal side, and further, the pattern of a beam radiated from the antenna can be adjusted irrespectively of an elevation angle direction or a bearing direction, the interference in the above-described situation can be alleviated and the throughput can be improved. The technique disclosed in Japanese Unexamined Patent Publication (KOKAI) No. 6-350334 or Japanese Unexamined Patent Publication (KOKAI) No. 10-502220 does not at all suggest, in particular, the adjustment of the elevation angle direction of the radiation pattern, and thus, cannot solve the above-described problems.

SUMMARY OF THE INVENTION

The present invention has been accomplished in view of the above-described problems. An object of the present invention is to provide a LAN antenna in which an interference or the like can be alleviated and a throughput can be improved, and a reflector therefor.

To obtain the above object, the present invention basically adopts the following technical constitution.

The first aspect of the present invention is a LAN antenna having a directivity comprising: a base table a projection member for enclosing an antenna element which projects from the base table a cylindrical member having a through hole, in which the projection member is fitted; and a reflector disposed on a side surface of the cylindrical member.

The second aspect of the present invention is a LAN antenna having a directivity comprising: a base table a projection member for enclosing an antenna element which projects from the base table; a cylindrical member having a through hole, in which the projection member is fitted; and a reflector disposed on a side surface of the cylindrical member wherein the cylindrical member is detachably fitted to the projection member.

In the third aspect of the present invention, the reflector comprising one or more flat plates and/or curved plates.

In the fourth aspect of the present invention, the reflector is disposed in such a manner that a reflecting surface of the reflector approaches a center thereof as the reflector goes to a bottom surface of the reflector.

In the fifth aspect of the present invention, the reflector is disposed in such a manner that a reflecting surface of the reflector approaches a center thereof as the reflector goes to a top surface of the reflector.

In the sixth aspect of the present invention, a reflecting surface of the reflector has a W-shape in a horizontal or vertical cross section.

In the seventh aspect of the present invention, a reflecting surface of the reflector has a V-shape in a horizontal or vertical cross section.

In the eighth aspect of the present invention, a reflecting surface of the reflector has a parabolic curve in a vertical or horizontal cross section.

In the ninth aspect of the present invention, the reflector is a parabolic reflector.

DETAILED DESCRIPTION OF THE PREFERRED EMBODIMENTS

Preferred embodiments according to the present invention will be described in detail below in reference to the accompanying drawings.

Figure 1:
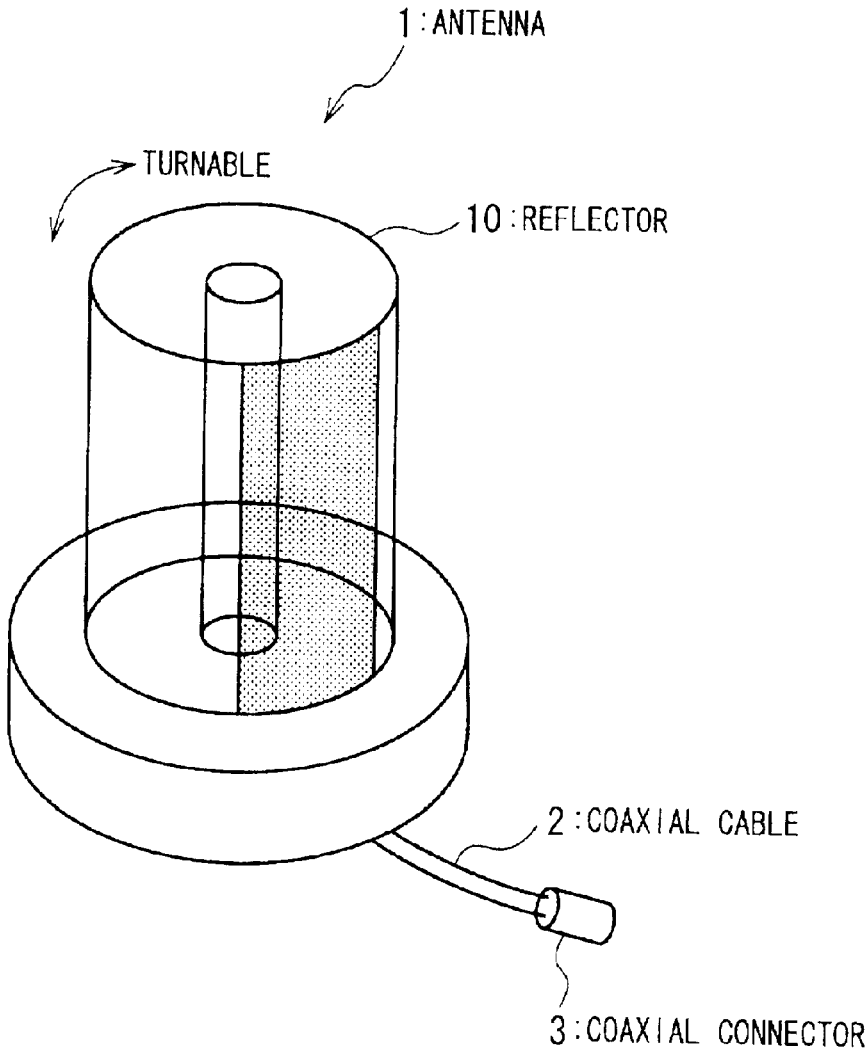
FIG. 1 is a perspective view showing the configuration of a LAN antenna 1 in a preferred embodiment according to the present invention.
Figure 2:
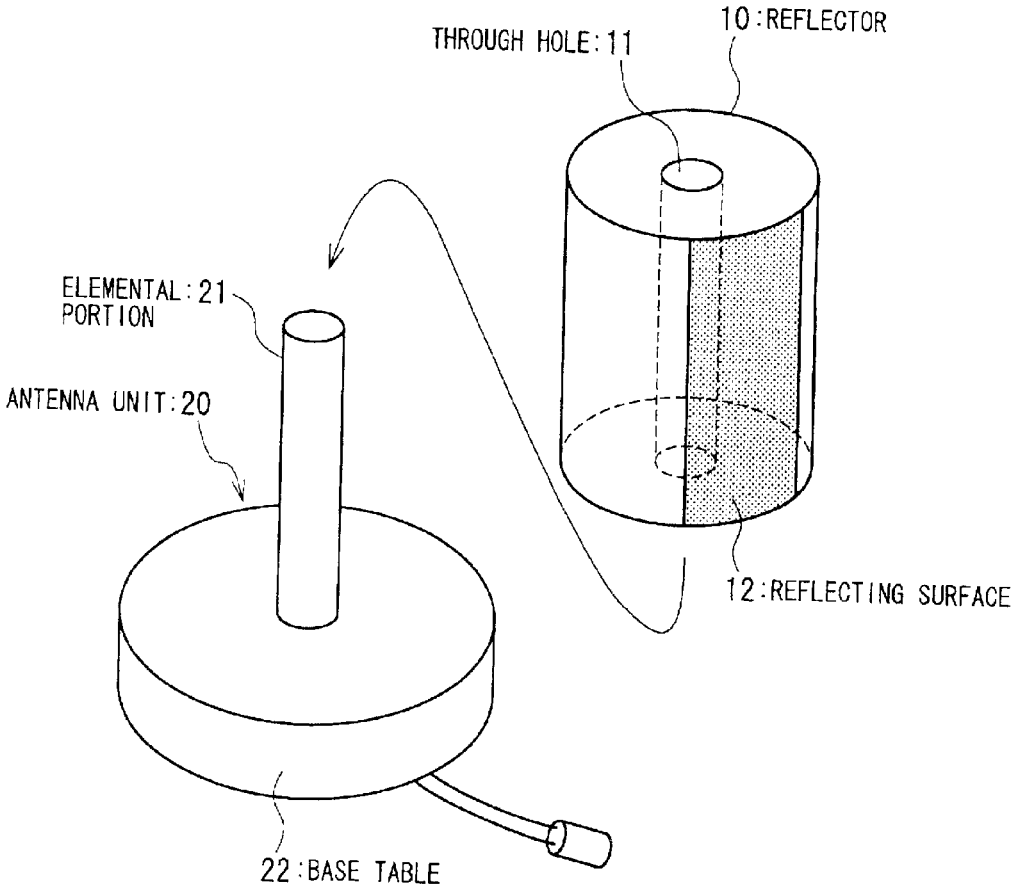
FIG. 2 is a perspective view showing the configuration in which a reflector 10 is detached from the LAN antenna 1 in the preferred embodiment according to the present invention.

FIG. 1 is a perspective view showing the configuration of a LAN antenna 1 in a preferred embodiment according to the present invention. FIG. 2 is a perspective view showing the configuration in which a reflector 10 is detached from the LAN antenna 1 in the preferred embodiment according to the present invention. In FIG. 1, to the antenna 1 are connected a coaxial cable and a coaxial connector 3. In FIG. 2, the LAN antenna 1 is constituted of the cylindrical reflector 10 and an antenna unit 20.

At the center of the reflector 10 is bored a through hole 11, which is fitted to an elemental portion 21 in the antenna unit 20. Furthermore, a reflecting surface 12 is constituted of the surface (inclusive of a curved surface) formed by a conductor made of metal or the like. Here, the antenna unit 20 includes the elemental portion 21 and a base table 22. The reflector 10 is detachably fitted to the antenna unit 20, and further, is configured in a turnable manner in a bearing direction.

Figure 3B:
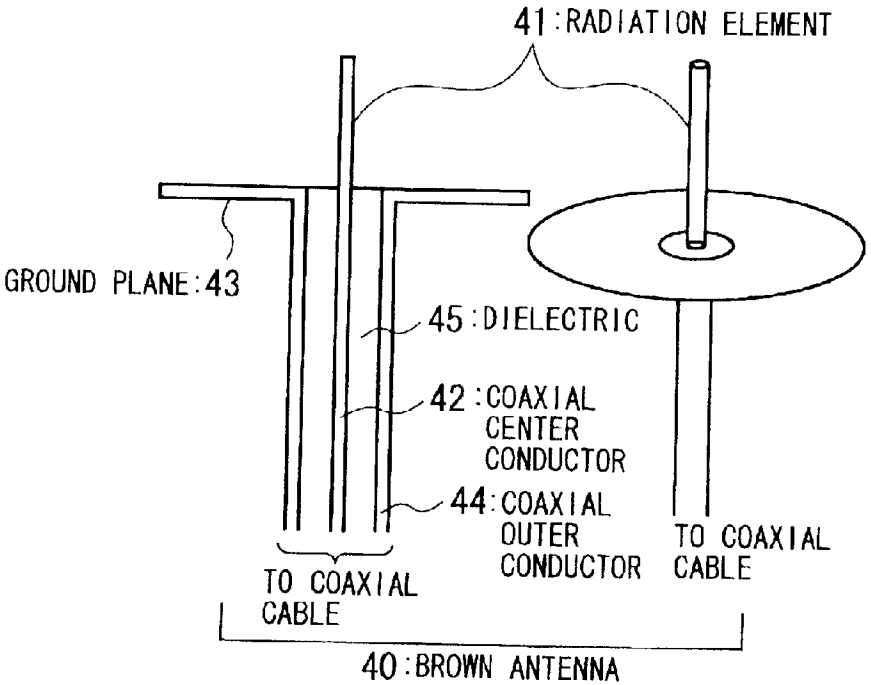
FIGS. 3(*a*) and 3(*b*) are perspective views showing the configuration of an antenna element which is used inside of the LAN antenna 1 in the preferred embodiment according to the present invention.
Figure 3A:
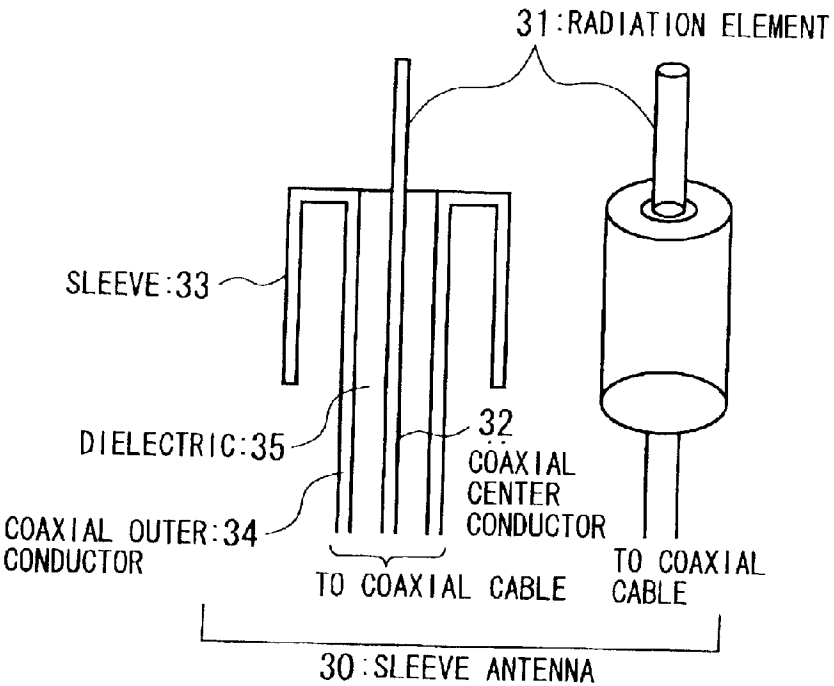

FIGS. 3(*a*) and 3(*b*) are perspective views showing the configuration of an antenna element which is used inside of the LAN antenna 1 in the preferred embodiment according to the present invention. FIG. 3(*a*) shows an example in which the elemental portion 21 is constituted of a sleeve antenna. FIG. 3(*b*) shows an example in which the elemental portion 21 is constituted of a Brown antenna.

The sleeve antenna 30 shown in FIG. 3(*a*) includes a radiation element 31 and a sleeve 33. RF power is supplied to the sleeve antenna 30 via a coaxial cable consisting of a coaxial center conductor 32, a dielectric 35 and a coaxial outer conductor 34. The sleeve 33 is connected to the coaxial outer conductor 34, and the radiation element 31 is connected to the coaxial center conductor 32.

In the same manner, the Brown antenna 40 shown in FIG. 3(*b*) includes a radiation element 41 and a ground plane 43. RF power is supplied to the Brown antenna 40 via a coaxial cable consisting of a coaxial center conductor 42, a dielectric 45 and a coaxial outer conductor 44. The ground plane 43 is connected to the coaxial outer conductor 44, and the radiation element 41 is connected to the coaxial center conductor 42.

Figure 4:
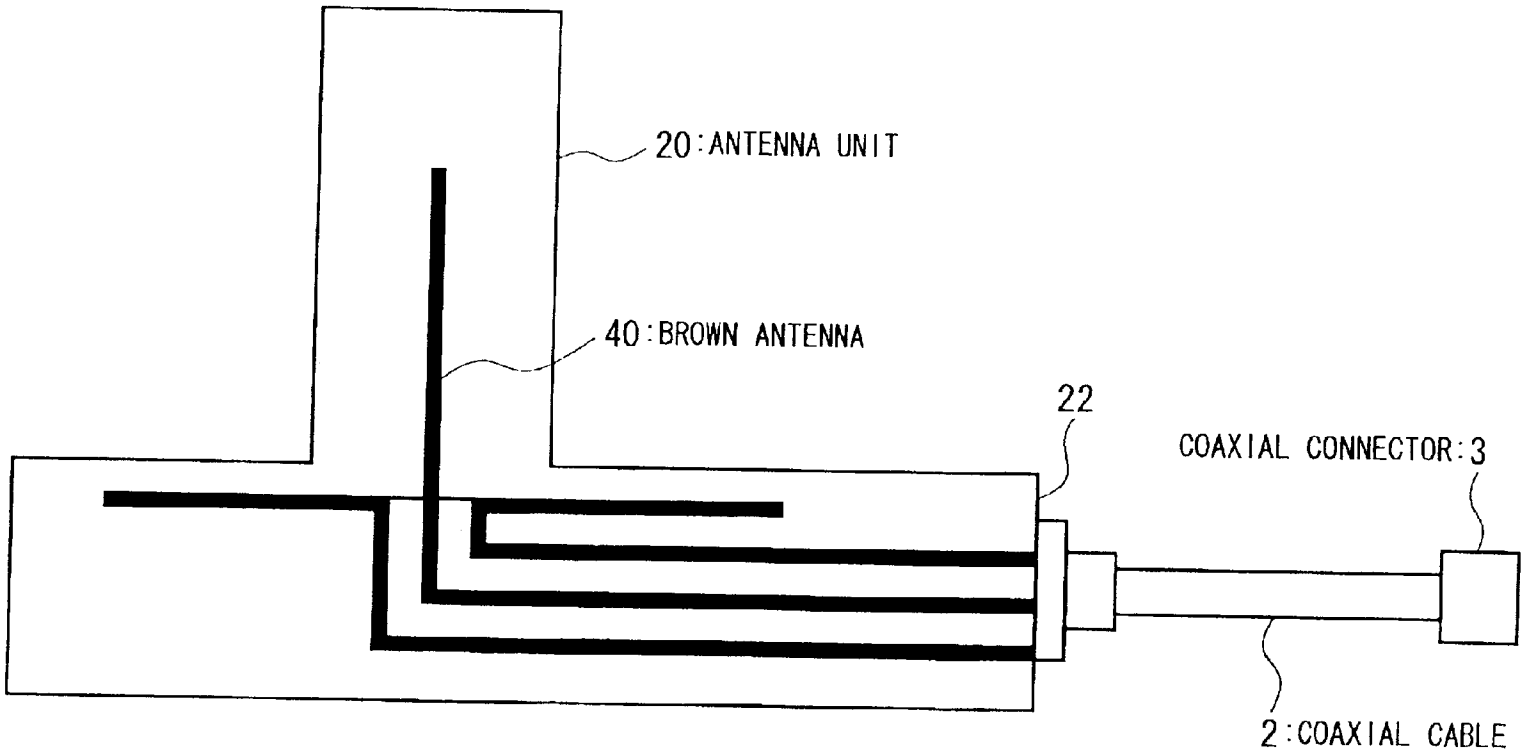
FIG. 4 is a cross-sectional view showing the configuration of an antenna unit 20 in which a Brown antenna shown in FIG. 3(*b*) is used.

FIG. 4 is a cross-sectional view showing the configuration of an antenna unit 20 in which a Brown antenna shown in FIG. 3(*b*) is used. The Brown antenna 40 is installed within a casing of the antenna unit 20. Moreover, the coaxial center conductor 42, the dielectric 45 and the coaxial outer conductor 44 are connected to the coaxial connector 3 through the coaxial cable 2 from the side surface of the base table 22.

Figure 5A:
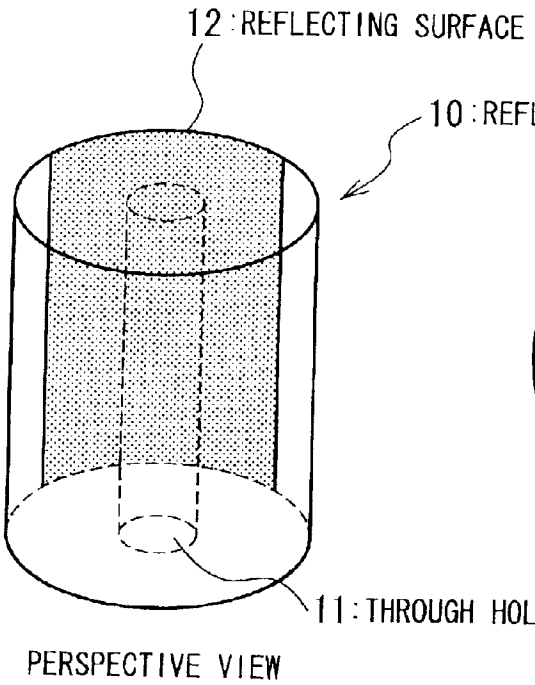
FIGS. 5(*a*) and 5(*b*) are views illustrating the details in the case in which the reflector 10 in the preferred embodiment according to the present invention has a cylindrical reflecting surface 12.
Figure 5B:
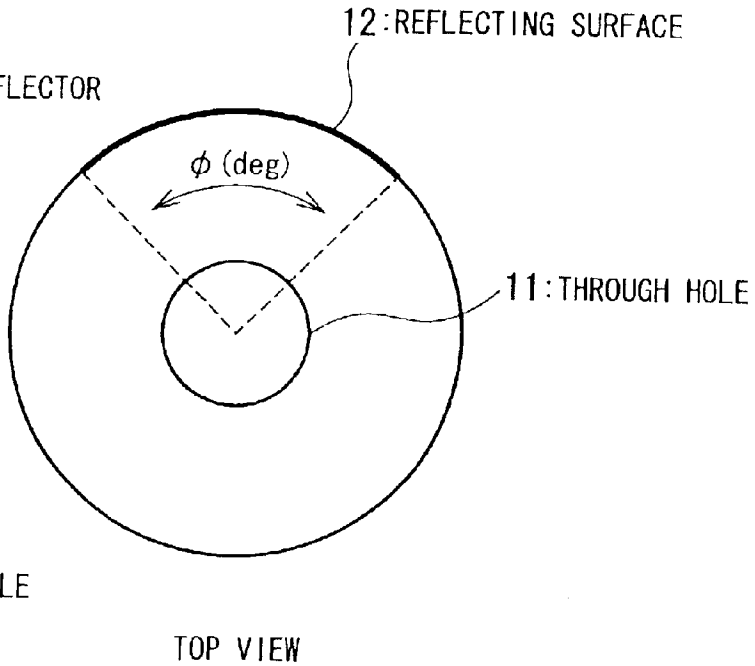
Figure 6A:
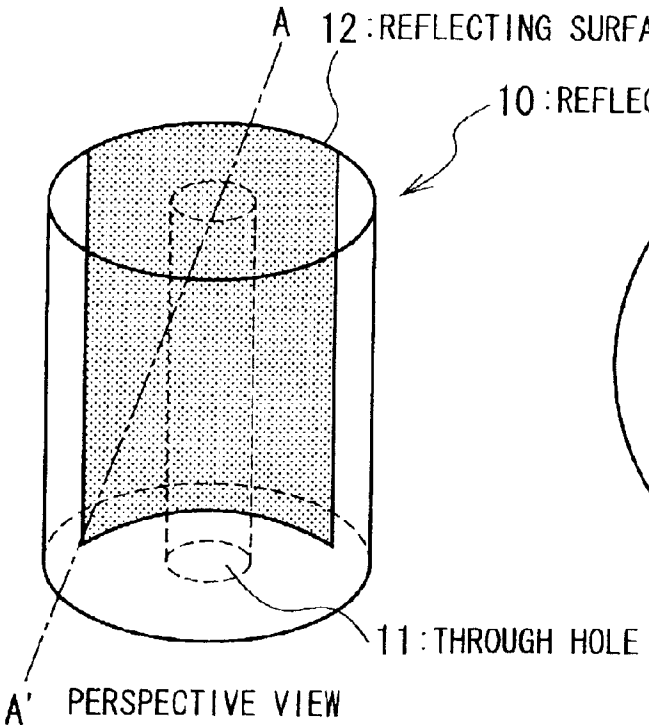
FIGS. 6(*a*) and 6(*b*) are views illustrating the details in the case where the reflecting surface 12 of the reflector 10 in the preferred embodiment according to the present invention has a shape obtained by cutting a part of a circular cone.
Figure 6B:
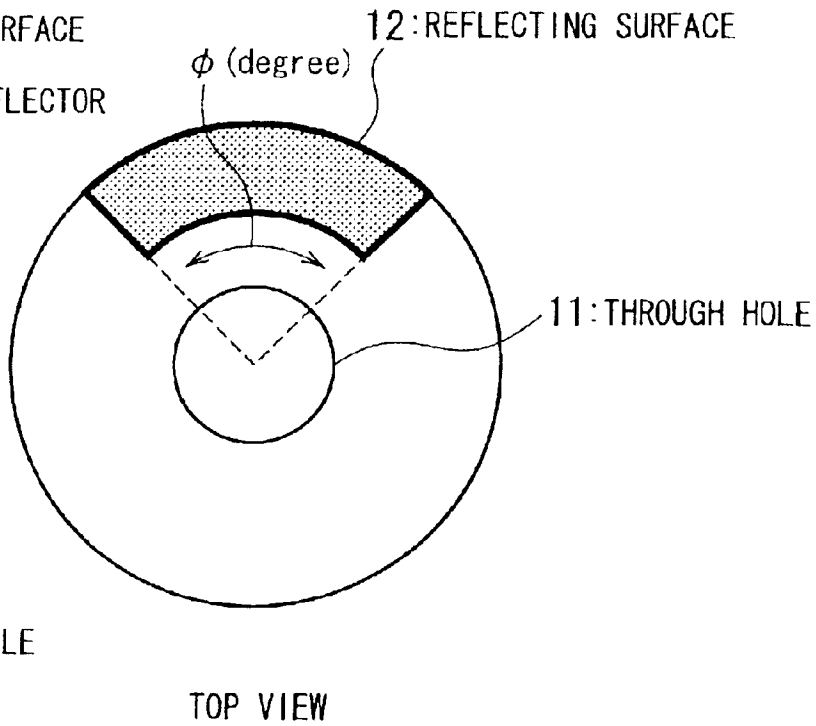
Figures 7A, 7B, 7C, 7D, 7E, 7F:
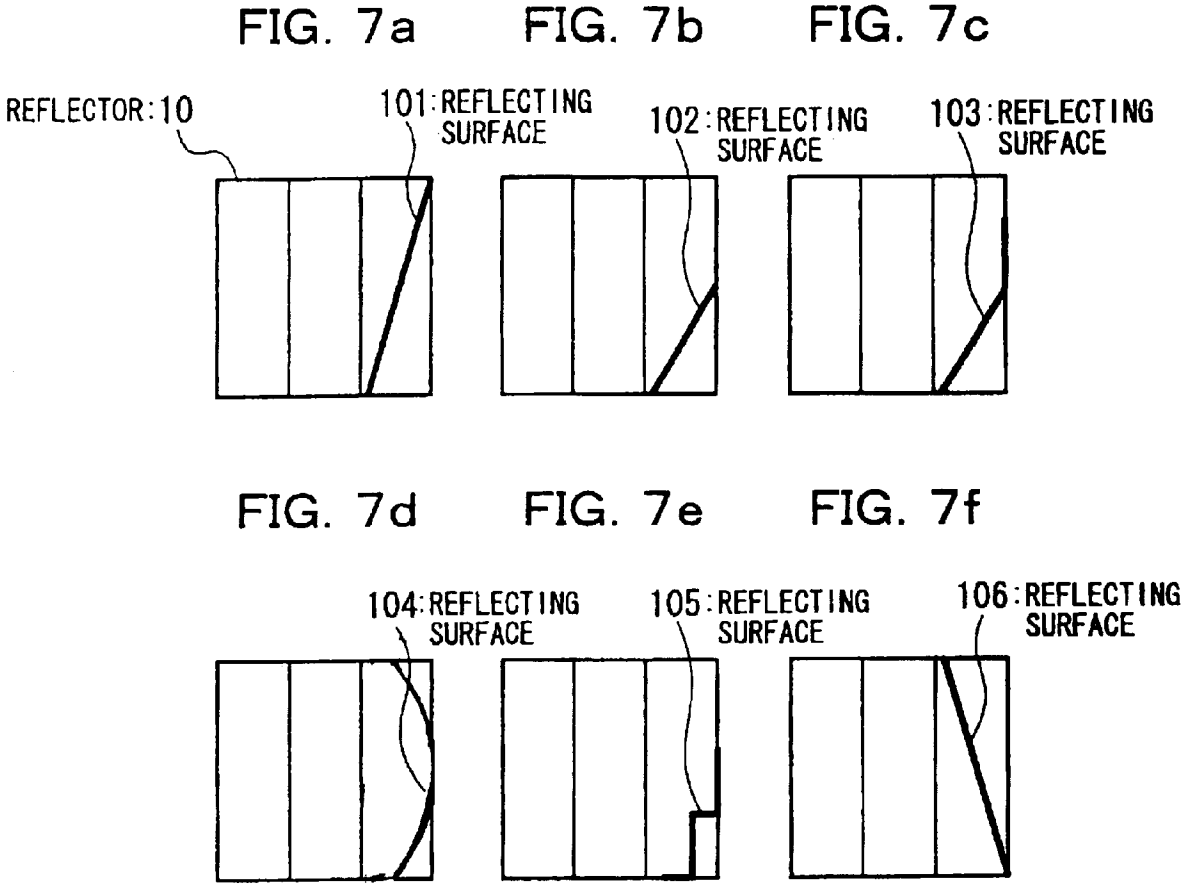
FIGS. 7(*a*) to 7(*f*) are cross-sectional views illustrating the preferred embodiment in which the reflecting surface 12 has various shapes, taken on a plane indicated by A–A' of FIG. 6.

FIGS. 5 to 7 illustrate various examples of the reflector 10 in the preferred embodiment according to the present invention. FIGS. 5(*a*) and 5(*b*) are views illustrating the details in the case in which the reflector 10 in the preferred embodiment according to the present invention has a cylindrical reflecting surface 12. FIG. 5(*a*) is a perspective view showing the reflector 10; in contrast, FIG. 5(*b*) is a top view showing the reflector 10. The reflecting surface 12 is constituted of a torus-like conductor, and is configured to be stuck around the reflector 10. In FIG. 5(*b*), the reflecting surface 12 covers an area at an angle $\phi$ of 180° or less with respect to the center of the cylindrical reflector 10.

FIGS. 6(*a*) and 6(*b*) are views illustrating the details in the case in which the reflecting surface 12 of the reflector 10 in the preferred embodiment according to the present invention has a shape obtained by cutting a part of a circular cone. FIG. 6(*a*) is a perspective view showing the reflector 10; in contrast, FIG. 6(*b*) is a top view showing the reflector 10. In comparison with the reflecting surface 12 shown in FIGS. 5(*a*) and 5(*b*), the reflecting surface 12 shown in FIGS. 6(*a*) and 6(*b*) approaches the center as it goes toward the bottom surface of the reflector 10.

FIGS. 7(*a*) to 7(*f*) are cross-sectional views illustrating the preferred embodiment in which the reflecting surface 12 has various shapes, taken on a plane indicated by A–A' of FIG. 6. FIGS. 7(*a*) to 7(*f*) illustrate the relationship between the reflector 10 and the reflecting surface 12. FIG. 7(*a*) illustrates the example shown in FIG. 6. FIG. 7(*b*) illustrates the case in which a reflecting surface 102 reaches the wall surface of a cylinder on the way, wherein an elevation angle of the antenna can be increased in comparison with the example shown in FIG. 7(*a*).

FIG. 7(*c*) illustrates the example in which a reflecting surface 103 shown in FIG. 1(*b*) reaches the wall surface of the cylinder, and then, extends upward on the wall surface thereof. FIG. 7(*d*) illustrates the example in which a reflecting surface 104 has a parabola, i.e., a parabolic reflecting surface, or an arbitrary curve similar to the parabola similar to the parabola in cross section. FIG. 7(*e*) illustrates the example in which a reflecting surface 105 has a step-like cross section. FIG. 7(*f*) illustrates the example in which a reflecting surface 106 has an inclined cross section leaning on the through hole bored at the center, to the contrary to the example illustrated in FIG. 7(*a*).

As shown above in FIGS. 1 and 2, the reflector 10 is detachably fitted to the antenna unit 20, and is configured in a turnable manner in a bearing direction. Hereinafter, explanation will be made on the arrangement for obtaining a desired radiation pattern by the use of the configuration.

FIGS. 11(*a*) to 11(*f*) are views showing the shapes of the reflecting surfaces disposed in the reflector 10 in the preferred embodiment according to the present invention. FIGS. 11(*a*) to 11(*f*) show various examples of the shape of the reflecting surface (the top views) in the case in which the prescribed radiation pattern in the bearing direction is obtained. For example, in the case in which the desired radiation pattern in the bearing direction is obtained, the shapes of the reflecting surface disposed inside of the reflector 10 are devised as shown in FIGS. 11(*a*) to 11(*f*).

FIG. 11(*a*) shows the reflector 10 viewed from the top, wherein a reflecting surface 601 is constituted of a conductor made of a flat plate. FIG. 11(*b*) shows a reflecting surface 602 which is arranged in a L-shaped manner, and thus, forms a sort of corner reflector. A reflecting surface 603 shown in FIG. 11(*c*) consists of three pieces of flat conductors. A reflecting surface 604 shown in FIG. 11(*d*) consists of a W-shaped conductor. It has been known that when this type of W-shaped reflector is arranged, the radiation pattern becomes a sectorial beam (i.e., a fanned beam). (Paper entitled "Fanned Beam Antenna by Printed Dipole Array with Reflecting Plate", 1988, Spring National Meeting of the Institute of Electronic Information, 1-121)

A reflecting surface 605 shown in FIG. 11(*e*) consists of a conductor made of a convex curved plate. This reflecting surface can form a radiation pattern having a broad beam in the bearing direction. A reflecting surface 606 shown in FIG. 11(*f*) consists of a conductor having a shape obtained by arbitrarily adjusting the arc of the reflector 10.

As is clear from the above description, a designer can design an antenna having a desired radiation pattern by arbitrarily combining the arrangement of the reflecting surface for controlling the direction of the elevation angle of the radiation pattern shown in any of FIGS. 7(*a*) to 7(*f*) with the arrangement of the reflecting surface for controlling the bearing direction of the radiation pattern shown in any of FIGS. 11(*a*) to 11(*f*).

Figure 8A:
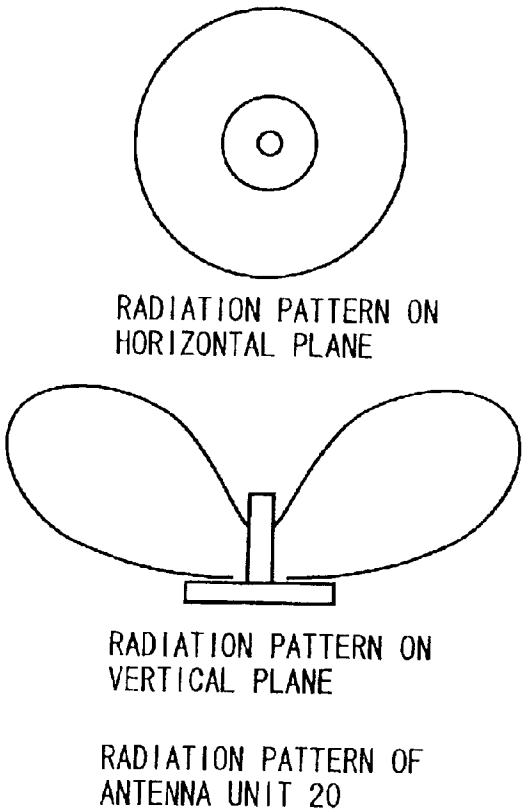
FIGS. 8(*a*) and 8(*b*) are views illustrating examples of radiation patterns in the LAN antenna 1 in the preferred embodiment according to the present invention.
Figure 8B:
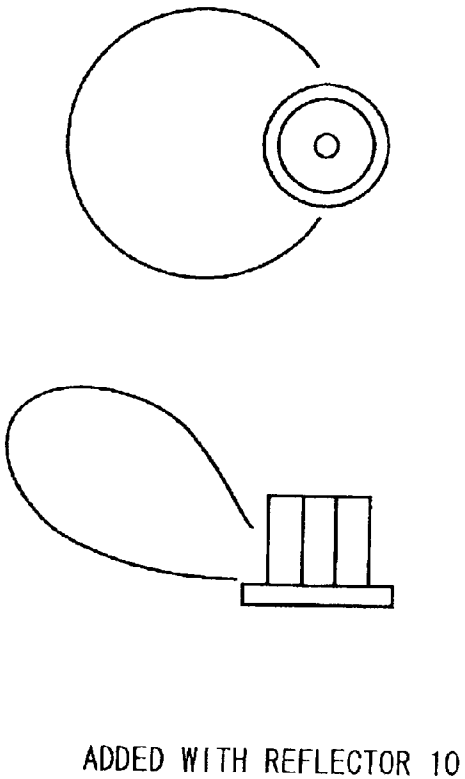

Subsequently, a description will be given below of an electric operation of the LAN antenna 1 in the preferred embodiment according to the present invention. FIGS. 8(*a*) and 8(*b*) are views illustrating examples of radiation patterns in the LAN antenna 1 in the preferred embodiment according to the present invention. The radiation pattern depends upon the shapes of the reflecting surfaces shown in FIGS. 5 to 7. FIG. 8(*a*) schematically shows the radiation pattern in the case in which there is no reflector 10. FIG. 8(*b*) schematically shows the radiation pattern in the case in which the reflecting surface 12 is disposed as shown in FIG. 5. In each of FIGS. 8(*a*) and 8(*b*), an upper view illustrates the radiation pattern on a horizontal plane; in contrast, a lower view illustrates the radiation pattern on a vertical plane.

In this manner, the antenna unit 20 is added with the reflector 10, so that the beam of the radiation pattern in the bearing direction can be limited in a single direction. Consequently, it is possible to prevent any interference with other access points in the LAN environment, to adjust the beam in a direction in which the condition is more optimum, or to select an access point with little access.

Figure 9:
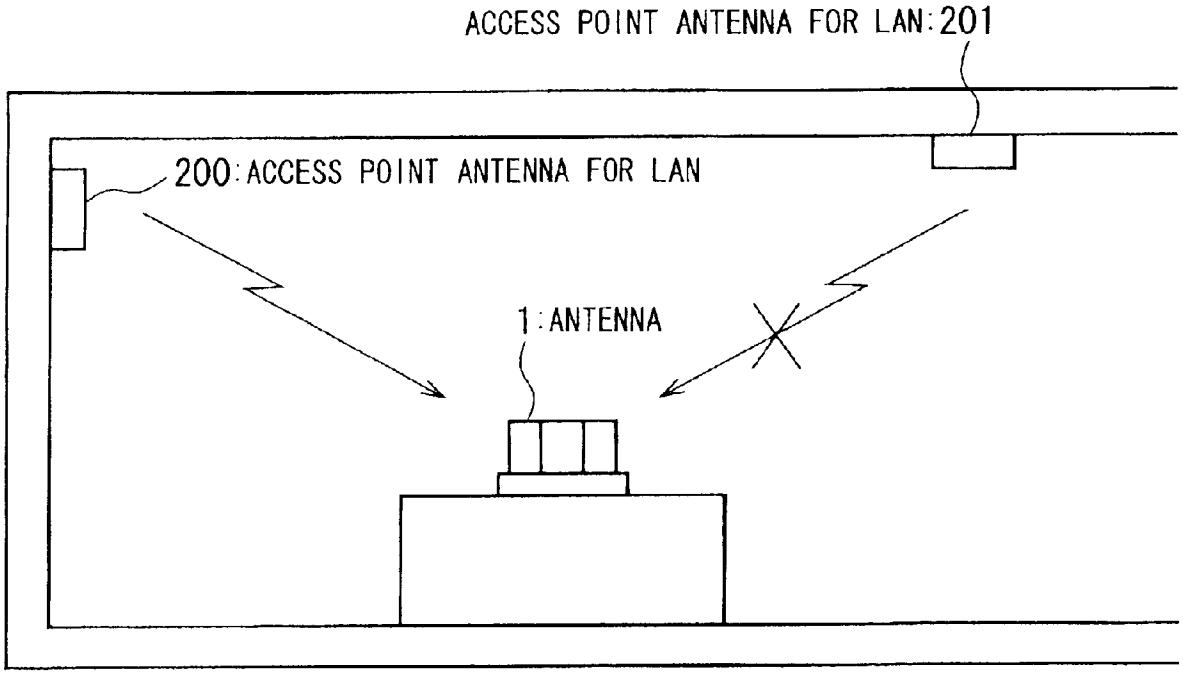
FIG. 9 is a first view illustrating an example in which the LAN antenna 1 in the preferred embodiment according to the present invention is used in the environment of an office.
Figure 10A:
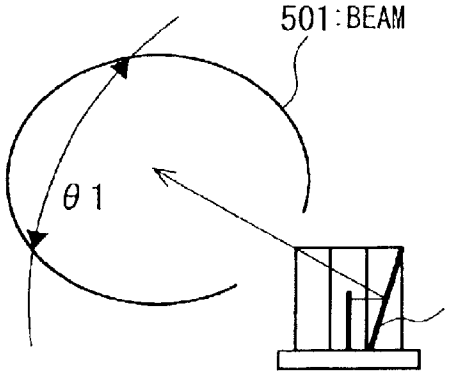
FIGS. 10(*a*) to 10(*d*) are cross-sectional views illustrating how the radiation pattern within an elevation angle surface is varied when using a reflector shown in FIGS. 7(*a*), 7(*d*) and 7(*f*).
Figure 10B:
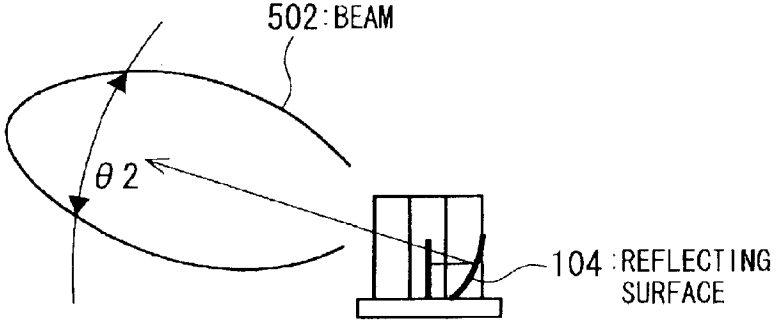
Figure 10C:
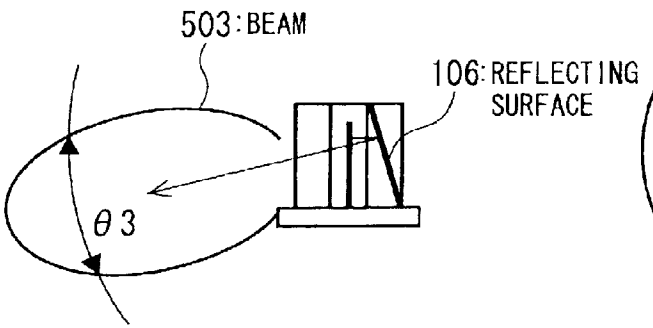
Figure 10D:
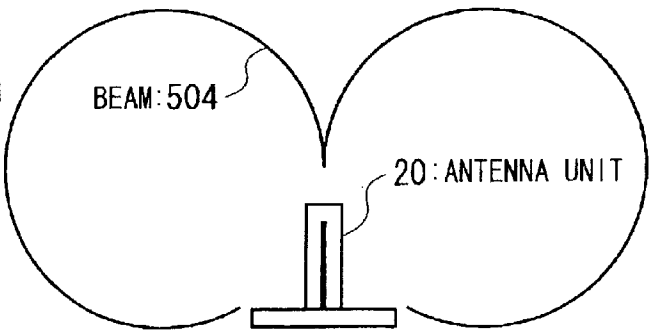
Figure 11A:
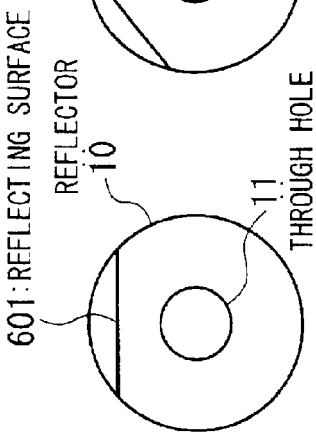
FIGS. 11(*a*) to 11(*f*) are views showing the shapes of the reflecting surfaces of the reflector 10 in the preferred embodiment according to the present invention.
Figure 11B:
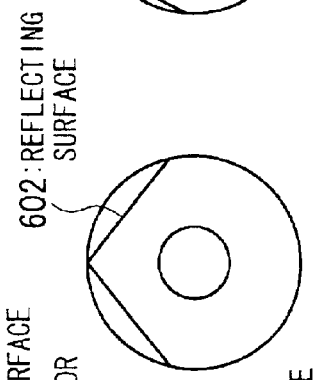
Figure 11C:
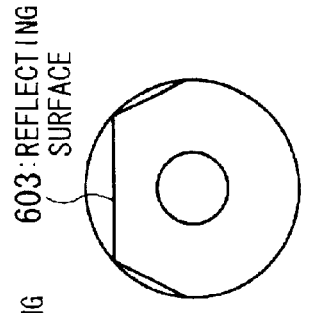
Figure 11D:
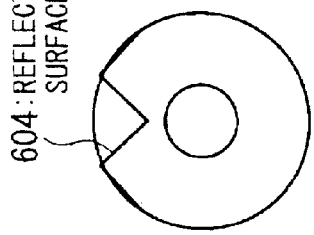
Figure 11E:
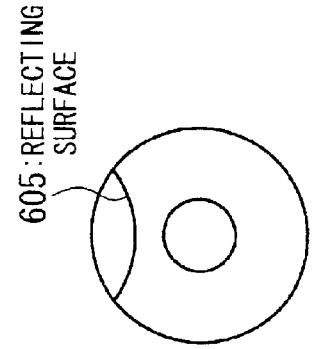
Figure 11F:
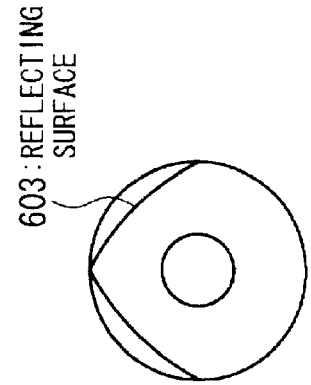

FIG. 9 is a first view illustrating an example in which the LAN antenna 1 in the preferred embodiment according to the present invention is used in the office. By selecting the radiation pattern shown in FIG. 8(*b*), the beam of the antenna 1 can be directed to a desired access point antenna 200 illustrated in FIG. 9.

FIGS. 10(*a*) to 10(*d*) are cross-sectional views illustrating how the radiation pattern within an elevation angle surface is varied by using the reflector shown in FIGS. 7(*a*), 7(*d*) and 7(*f*). Normally, when the antenna 1 shown in FIG. 2 is operated only by the antenna unit 20 without any reflector 10, a radiation pattern 504 symmetric in rotation, can be obtained as illustrated in FIG. 10(*d*). When the antenna with the above-described radiation pattern is installed at a location illustrated in FIG. 9, it can communicate with two access points 200 and 201, thereby causing an interference.

In the same state, a radiation pattern illustrated in FIG. 10(*a*) is a unidirectional beam 501 by the effect of the reflecting surface 101, thus preventing any interference with the right access point 201 illustrated in FIG. 9. Moreover, a radiation pattern illustrated in FIG. 10(*b*) can provide a sharper beam 502 since the reflecting surface 104 forms the parabolic surface with respect to the surface of the elevation angle. Naturally, the beam width θ2 of the beam 502 is narrower than the beamwidth θ1 of the beam 501, and therefore, the gain of the beam 502 becomes greater by the difference in beam width.

A radiation pattern illustrated in FIG. 10(*c*) is effective in the case in which the access point is located somewhat under a terminal station. This is because the radiation pattern illustrated in FIG. 10(*c*) forms a downward beam 503 by the use of the reflecting surface 105.

Figure 12A:
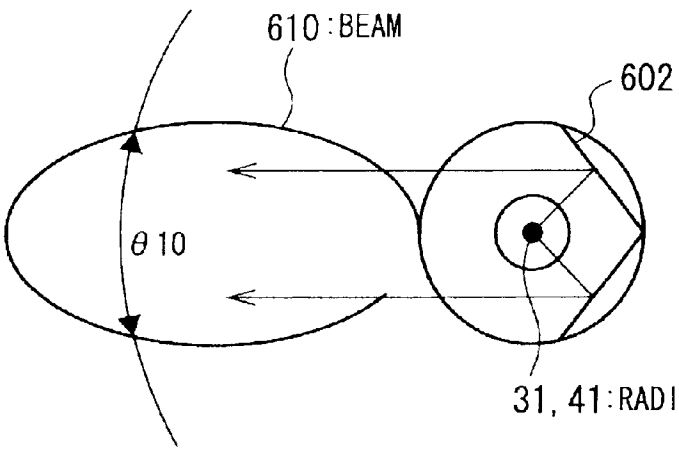
FIGS. 12(*a*) and 12(*b*) are views illustrating the radiation patterns of the antenna having a reflector shown in FIGS. 11(*b*) and 11(*d*), respectively.
Figure 12B:
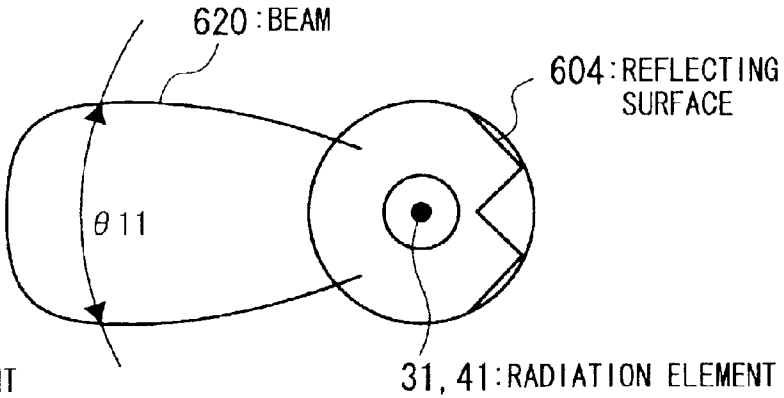

FIGS. 12(*a*) and 12(*b*) are views illustrating the radiation patterns in FIGS. 11(*b*) and 11(*d*), respectively. When the reflecting surface 602 illustrated in FIG. 11(*b*) is used, the reflector 10 functions as a corner reflector. In a beam 610 illustrated in FIG. 12(*a*), radio waves reflected from the radiation elements 31 and 41 disposed at the center of the antenna are synthesized in the same phase in the same direction, thereby forming a unidirectional sharp beam.

Moreover, the reflecting surface 604 illustrated in FIG. 11(*d*) forms a fanned beam 620, as illustrated in FIG. 12(*b*). The above-described beam formation is effective in the environment as illustrated in FIG. 13.

Figure 13:
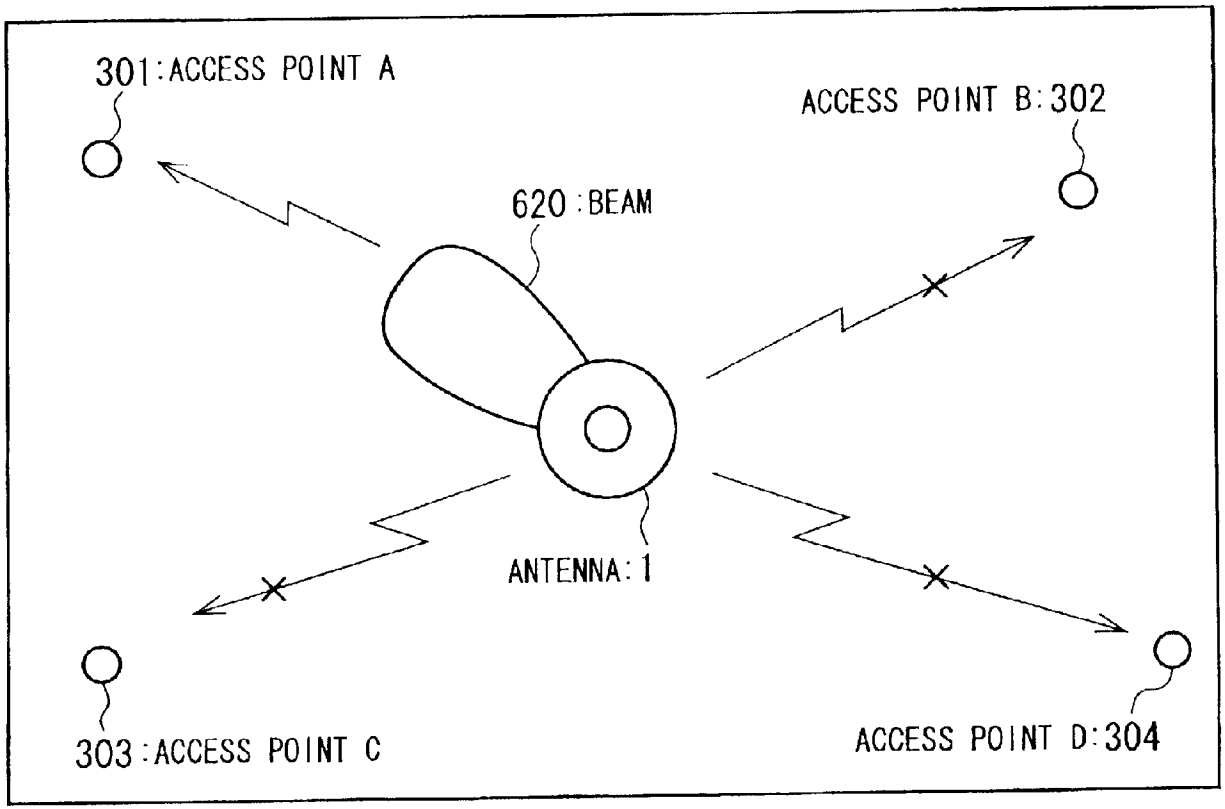
FIG. 13 is a second view illustrating a use example of the LAN antenna 1 in the preferred embodiment according to the present invention.

FIG. 13 is a second view illustrating a use example of the LAN antenna 1 in the preferred embodiment according to the present invention. FIG. 13 is a view illustrating the indoor LAN environment, as viewed from the top. In the situation in which there are four access points A to D and a terminal station is located at substantially the center of the four access points, communications cannot be excellently achieved by the adverse influence of an interference if the antenna directivity of the terminal station is non-directivity.

However, if the antenna 1 has a fanned beam like the beam 620 as illustrated in FIG. 13, the antenna 1 can communicate with only the access point A 301 without any interference with other access points. In this case, the use of either of the unidirectional sharp beam and the fanned beam is selected case by case, as illustrated in the two examples in FIGS. 12(*a*) and 12(*b*).

That is to say, in the case in which the terminal station is of a type which is seldom moved, such as a desktop personal computer, and further, the antenna for the LAN also is seldom moved, it is more advantageous to use the unidirectional antenna having a sharp beam for use. In contrast, in the case in which the terminal station is of a type which is frequently carried, such as a notebook personal computer, and further, the antenna connected to the outside also is frequently moved, the fanned beam is considered to be advantageous without any need of a severe direction adjustment.

The above-described embodiment has been merely one example of the preferred embodiment according to the present invention, and the present invention is not limited to the above-described embodiment. Therefore, a variety of modifications and alterations can be embodied without departing from the scope of the present invention.

As is clear from the above description, according to the present invention, the strong directivity from the access point can be obtained under the LAN environment by additionally providing the reflector in the antenna and turning it, thus improving the throughput or BER (i.e., alleviating the interference with other access points or the like).

Furthermore, the reflector is attached to or detached from the antenna, thus varying the antenna directivity. Namely, the antenna having the directivity in an arbitrary direction can be configured by attaching the reflector to the antenna; in contrast, the antenna having non-directivity can be configured by detaching the reflector from the antenna. Consequently, a more optimum access point can be selected under the LAN environment.

In addition, the antenna according to the present invention can be used in the same manner as a normal LAN antenna even in the state in which no reflector is provided, and thus, it is excellent in general versatility.

Moreover, the radiation pattern can be freely formed in an arbitrary elevation angle or bearing direction according to the shape of the reflecting surface of the reflector. For example, as for the elevation angle, the board or sharp beam can be formed or the elevation angle can be changed. Additionally, as for the bearing direction, the board or sharp beam can be formed, or the fanned beam can be formed. Here, the center of the beam can be readily changed by turning the reflector.

What is claimed is:

1. A LAN antenna having a directivity, comprising:

a base table;

a projection member for enclosing an antenna element which projects from said base table;

a cylindrical member having a through hole, in which said projection member is fitted; and a reflector partially contacting an outer side surface of said cylindrical member;

wherein said cylindrical member is detachably fitted to said projection member, and wherein said outer side surface of the cylindrical member includes a surface substantially parallel to an axis of the cylindrical member.

2. The LAN antenna according to claim 1, wherein said reflector comprises one of a flat plate and a curved plate.

3. The LAN antenna according to claim 1, wherein said reflector is disposed in such a manner that a reflecting surface of said reflector approaches a center thereof as said reflector goes to a bottom surface of said reflector.

4. The LAN antenna according to claim 1, wherein said reflector is disposed in such a manner that a reflecting surface of said reflector approaches a center thereof as said reflector goes to a top surface of said reflector.

5. The LAN antenna according to claim 1, wherein a reflecting surface of said reflector comprises a W-shape in one of a horizontal and a vertical cross section.

6. The LAN antenna according to claim 1, wherein a reflecting surface of said reflector comprises a V-shape in one of a horizontal and a vertical cross section.

7. The LAN antenna according to claim 1, wherein a reflecting surface of said reflector comprises a parabolic curve in one of a vertical and a horizontal cross section.

8. The LAN antenna according to claim 1, wherein said reflector comprises a parabolic reflector.

* * * * *